US006335691B1

(12) United States Patent
Bird

(10) Patent No.: US 6,335,691 B1
(45) Date of Patent: Jan. 1, 2002

(54) MUSICAL BOTTLE

(75) Inventor: Darrell Bird, 7117 Atwell, Houston, TX (US) 77081

(73) Assignee: Darrell Bird, Houston, TX (US)

( * ) Notice: Subject to any disclaimer, the term of this patent is extended or adjusted under 35 U.S.C. 154(b) by 0 days.

(21) Appl. No.: 09/634,196

(22) Filed: Aug. 9, 2000

(51) Int. Cl.[7] ..... G08B 3/00

(52) U.S. Cl. ..... 340/691.1; 340/692; 340/568.1; 340/570; 340/573.1; 340/600; 206/213.1

(58) Field of Search ..... 340/691.1, 692, 340/568.1, 568.8, 570, 571, 555, 600, 573.1; 206/213.1; 446/129; 235/380; 40/473; 381/124

(56) References Cited

U.S. PATENT DOCUMENTS

| | | | | |
|---|---|---|---|---|
| 4,482,067 A | | 11/1984 | Saito et al. | |
| 4,678,093 A | | 7/1987 | Allen | |
| 5,000,331 A | | 3/1991 | Conlon et al. | |
| 5,004,909 A | * | 4/1991 | Fukuchi | 209/526 |
| 5,130,696 A | * | 7/1992 | Liebman | 340/540 |
| 5,266,920 A | * | 11/1993 | Langner | 340/692 |
| 5,344,034 A | | 9/1994 | Eagan | |
| 5,442,869 A | | 8/1995 | McDarren | |
| 5,489,893 A | * | 2/1996 | Jo et al. | 340/686 |
| 5,575,553 A | * | 11/1996 | Tipton | 362/101 |
| 5,625,347 A | * | 4/1997 | MacLean et al. | 340/686 |
| 5,990,790 A | * | 8/1998 | Lusareta | 340/571 |
| 5,910,768 A | * | 6/1999 | Ott | 340/568.2 |
| 6,000,985 A | | 12/1999 | Yeh | |
| 6,024,625 A | | 2/2000 | Pearce | |
| 6,042,004 A | | 3/2000 | Domiteaux | |

* cited by examiner

*Primary Examiner*—Jeffery Hofsass
*Assistant Examiner*—Daniel Previl
(74) *Attorney, Agent, or Firm*—Buskop Law Group, P.C.; Wendy K. Buskop

(57) ABSTRACT

A bottle consisting of an upper portion with a neck, a lower portion with a recess, having a disc disposed in the recess which has either a phototransistor or a press switch to activate a battery unit, with a control circuit and a speaker to hear sounds from the bottle when moved or light affected.

12 Claims, 3 Drawing Sheets

MUSICAL BOTTLE

BACKGROUND OF THE INVENTION

This invention relates to an alcohol bottle, such as a tequila bottle, capable of playing music or spoken words, producing an interesting effect to attract consumers curiosity.

At Present most bottles are made without sound producing means, except for baby bottles. Prior art references include U.S. Pat. No. 6,042,004 titled "Talking Bottle Cap Reader" which relates to an interactive system for reading cards using a device embedded in a bottle cap. The present invention is directed to a bottle, not a cap that can provide sounds, illumination, and information displays.

U.S. Pat. No. 600,985 "Cup" is directed to a cup with a rotatable base having a plurality of magnets in a groove on the body which cause sparkling objects to move or music to play. The cup has a picture adhered to the outer surface, and a post with magnets disposed on the base to cause the base to rotate. The present invention does not involve the use of magnets, which can demagnetize credit cards.

Other US patents are noted of interest but not considered material to the examination of this patent but include U.S. Pat. Nos. 6,037,872, 6,024,625, 5,842,901, 5,704,505, 5,489,893, 5,344,034, 4,930,902 and 4,678,093 which are mainly directed to baby bottles which play music. The present invention is an "adult" device, for holding alcohol, which in the preferred embodiment is made from glass, and therefore considered to be significantly different from a baby bottle.

Other patents of note include U.S. Pat. Nos. 6,039,453, 5,947,406, 5,696,333, 5,442,869, 4,983,119, and 4,755,135 which are directed to musical objects.

Additionally, U.S. Pat. No. 5,000,331 is noted which was a lightweight bottle stabilized against tipping with a lead weight. The present invention uses a detachable base in one embodiment, but has increased functionality for providing information on the base rather than just weighting the base.

Finally, synthetic resin bottle patents are noted, as this invention may be applied to such bottles, including U.S. Pat. No. 4,482,067.

SUMMARY OF THE INVENTION

The purpose of the invention is to offer a kind of bottle having an audio chip activated by a press switch or a photo transistor, energized by a battery unit.

Specifically, the invention is for a bottle for holding alcoholic beverages comprising: a liquor bottle containing an alcoholic beverage formed with an upper portion with a sealable neck, and a lower portion with a bottom; a disc removably secured to the bottom with the disc wherein the disc has a battery unit, a control circuit, a light activated actuator and a plurality of electrical transistors, an audio record and play chip, and a speaker.

In an alternative embodiment, the invention comprises a liquor bottle containing an alcoholic beverage formed from an upper portion with a sealable neck and a lower portion with a bottom; a disc disposed on the bottom, with a disc having a press switch, a battery unit, a control circuit, a plurality of transistors, an audio record and play chip, and a speaker.

In still another embodiment, the invention involves a liquor bottle holding an alcoholic beverage formed from an upper portion with a sealable neck, a lower portion with a bottom; and a removably detachable support having a top side which is removably connected to said bottom and a bottom side having walls creating a recess; and an information display embedded in the removably detachable support. It is contemplated to be within the invention that the information display can be comprised of paper, a 3-D object or combination thereof.

In yet another embodiment, the liquor bottle has a cavity for holding an alcoholic beverage formed from an upper portion with a sealable neck, a lower portion with a bottom; a removably detachable support having a top side which is removably connected to the base and a bottom side having walls creating a recess; and an illumination means display embedded in the removably detachable support.

Finally, the invention is a bottle for holding alcoholic beverages comprising: a body having a cavity for holding an alcoholic beverage formed from sidewalls, an upper portion with a sealable neck, a lower portion with a bottom and a recess formed in said bottom accessible through a slot formed in said sidewalls; and a removably insertable component which fits within said slot and substantially fills said recess. The component can be an information display, a music chip, illumination means or simply a painted fluorescent chip.

BRIEF DESCRIPTION OF THE DRAWINGS

The invention will be better understood by inferring to the accompanying drawings, wherein.

DETAILED DESCRIPTION OF THE PREFERRED EMBODIMENTS

Figure 1:
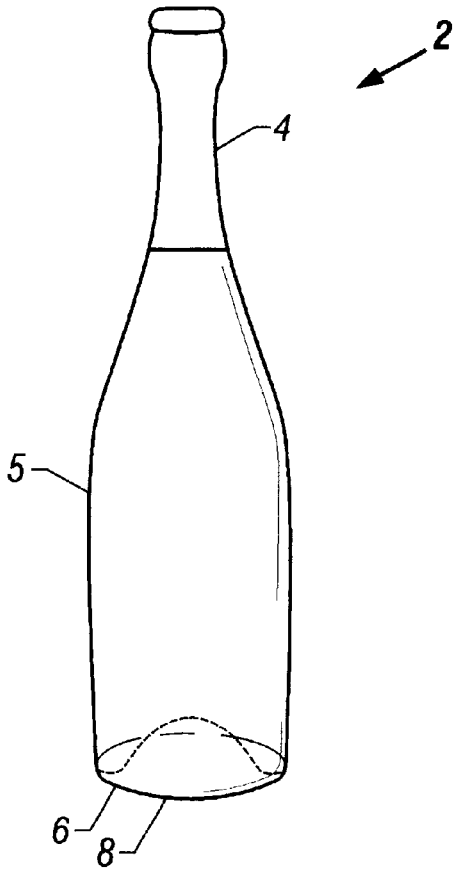
FIG. 1 is a side view of the inventive bottle.

A first embodiment is shown in FIG. 1, which includes a liquor bottle (2), which can be blue, brown or green glass, or possible clear glass having an upper portion, with a neck (4), a lower portion (5) with a bottom (6). The embodiment of this figure shows the bottle (2) further having a recess (8).

Figure 2:
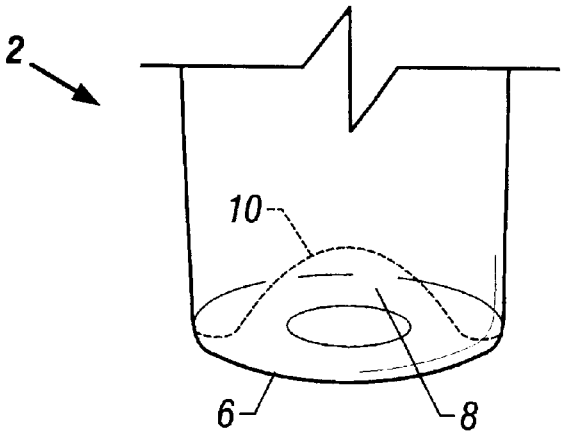
FIG. 2 is a perspective view of the bottom of the bottle.

As shown in FIG. 2, the recess (or possible the flat bottle bottom) is painted with a light resistant, or light blocking paint (10). The paint can be black or a metallic material or any other appropriate paint which will stop light from passing through the bottle of the recess. In an alternative embodiment the paint could be replaced with a light blocking paper which is adhered to the bottom of the bottle with a conventional adhesive or glue. Instill another embodiment, the light blocking material could be a flexible polymer or plastic, or possibly even a coated fabric or tightly woven fabric which can block light. If a non-paint material is used to block the light, it is preferred that the material be between 0.1 and 10 mm thick, and a thickness which will not project out of the recess.

Figure 3:
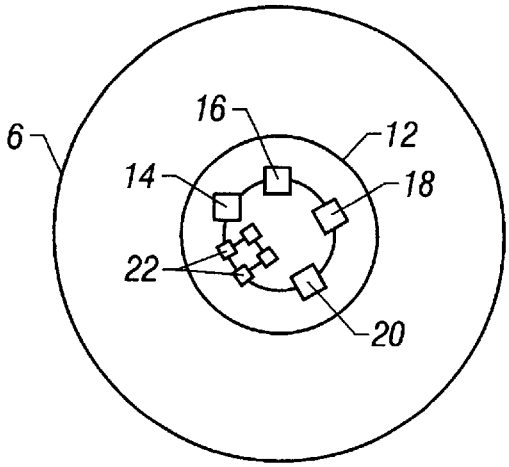
FIG. 3 is a detailed view of the cap containing the photo transistor.

Adhered to the paint (10) or paper is a disc (12). If not paint or paper is needed, then the disc can be directly adhered to the bottom of the bottle. FIG. 3 shows disc (12) having a battery unit (14), a control circuit (16), a phototransistor (18), and a speaker (20) with various transistors (22). In FIG. 3, the disc can record and play music or spoken words and be turned on or off based on light activation of the photo transistor (18) which is referred to herein as a light activated switch.

The control circuit can be a CPU (26). The CPU, the phototransistor and the battery unit are connected to one another, so when the phototransistor (18) receives signals from an emitter or light source, the battery unit (14) supplies electricity to the CPU and the control circuit. Then the control circuit turns on and plays music or another audio signal such as spoken words, or possibly turns on illumination means adhered to the bottom of the liquor bottle.

When the bottle is placed on a table, the phototransistor (18) is turned off. The light is stopped from reaching the switch. Once the bottle is lifted, the phototransistor is triggered such as by light reflected by the table surface and music plays or a greeting is sounded. When the bottle is on the table the collector or the phototransistor (18) cannot receive light given the emitter, turning off the phototransistor (18).

Figure 4A:
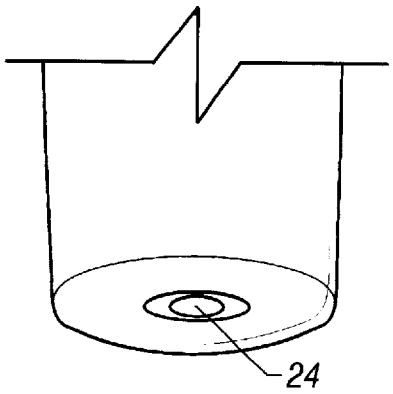
FIG. 4A and FIG. 4B are perspective views of the cap containing the press switch.
Figure 4B:
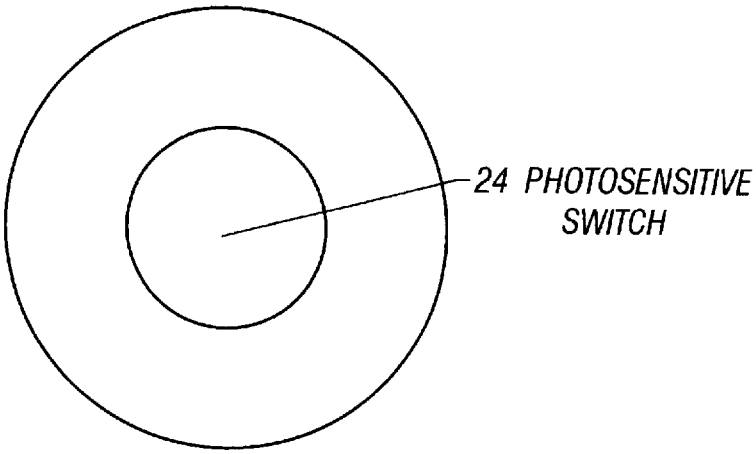

In a second embodiment, a press switch (24) can be provided to take pressure of the phototransistor (18) as shown in FIG. 4 for turning on and off the press switch (24) by placing bottle (2) on a table or by taking bottle (2) off the table so that the CPU (26) may be turned on and off In still another embodiment a element or a light may be attached to the control circuit and may be turned on or off by the phototransistor or the press switch. In still another embodiment, which uses a bottle with a recess, a small light can be added to illuminate the interior of the bottle as well.

Figure 5A:
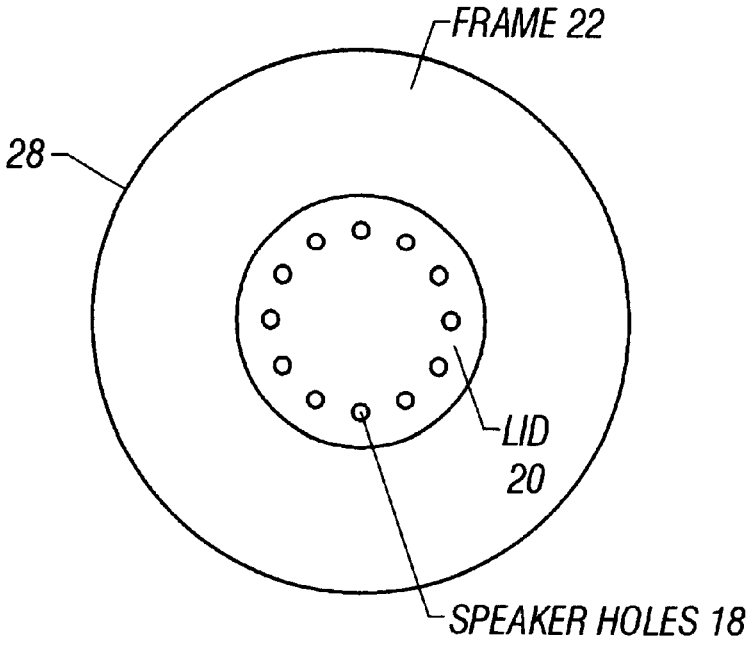
FIG. 5A and FIG. 5B are yet other embodiments of the invention having a separate base unit threadable to the lower portion of the bottle.
Figure 5B:
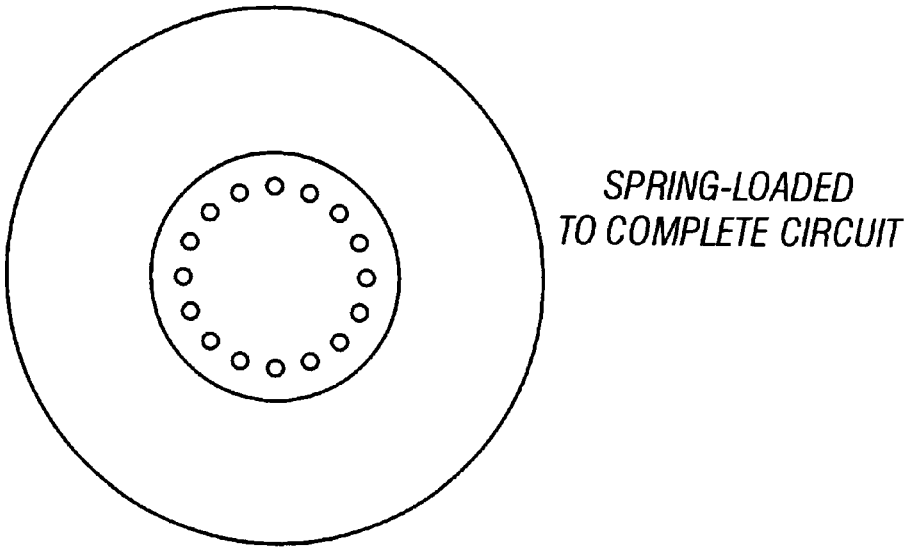

In still another embodiment of the present invention the bottle can have a lower portion which is threaded and connected to a separate base unit. The base unit can contain cute little objects, such as sea objects. As shown in FIG. 5 a base unit (28) with a threaded base portion (30) can contain the disc (12) with the optional illumination feature or optional music feature. The threaded base portion (30) can screw or engage the threaded bottle lower portion (32) or be secured with hinges or leather or other attaching means of a conventional type.

The present invention involves in one embodiment, a liquor bottle containing an alcoholic beverage formed with an upper portion with a sealable neck, and a lower portion with a bottom; a disc removably secured to the bottom with the disc containing a battery unit, a control circuit, a light activated actuator and a plurality of electrical transistors, an audio record and play chip, and a speaker. It is contemplated that the bottle is made from either transparent glass or light blocking glass or combinations thereof. If the embodiment uses the light activated actuators, then color glass is very useful, if transparent glass is contemplated, then the use of a light blocking paper or light blocking paint would be part of the invention. The light blocking substance can be selected from a group of substances, such as light blocking paper, plastic, glass or similar light blocking material. The light activated actuator can be disposed on a disc located on the bottom of the liquor bottle, or alternatively, if the bottle has a recess, the disc can be disposed in the bottom of the bottle, on the side opposite the cavity. In some embodiments, it is considered to be within the scope of the invention, that the disc be removably secured to the bottom of the bottle in the recess. This embodiment of the invention may also involve the used of an illumination element connected to the control circuit. It is contemplated that the illumination element can be turned on or off by the light activated actuator. Additionally, customer pleasing fluorescent paint could be disposed on the surface of the bottle opposite the cavity, which would be very useful in dark bars.

Bottles considered usable in this invention are most preferably glass bottles, but they can be selected from materials such transparent and light blocking polymers, plastics, acrylics, synthetic resins, metal, wood, porcelains, ceramics, laminates and combinations thereof.

In another embodiment, the invention can involve the liquor bottle containing an alcoholic beverage formed from an upper portion with a sealable neck and a lower portion with a bottom; a disc disposed on said bottom, wherein the disc has a press switch a battery unit, a control circuit, a plurality of transistors, an audio record and play chip, and a speaker.

In yet another embodiment, the invention involves a liquor bottle holding an alcoholic beverage formed from an upper portion with a sealable neck, a lower portion with a bottom; and a removably detachable support having a top side which is removably connected to the bottom and wherein the bottom further has walls creating a recess; and on information display is embedded in the removably detachable support. The information display can be comprised of paper, a 3-D object or combination thereof.

The information display can be a plurality of miniature beer cans, scorpions, advertising, beach scenes with sand, seashells, paper mache fish, tropical scenes, liquid filled moving art scenes, or combinations of such things. It is also viewed as being within the scope of the invention that the removably detachable support is threaded to the bottle. The invention with information display may also contain illumination means, fluorescent paint, or sound chips to create noise. If illumination means is used, it may be battery operated liquid crystals or LCD displays, micro-lights or micro-bulbs operated by batteries.

The invention is for liquor bottles where in the alcohol is vodka, rum, beer, gin, bourbon, scotch, cordials, tequila, mescal or wine.

The bottles of the invention can be one of a variety of sizes, such as 750 ml, 1 liter, 175 liter, gallons, 375 ml, beer bottles, pony bottle, and mini-bottles.

The audio chip of the invention is contemplated as one that can play drinking songs, spoken birthday greetings, wedding songs, animal sounds, recorded personal greetings, and music.

What is claimed is:

1. A bottle for holding alcoholic beverages comprising:

(a) A liquor bottle containing an alcoholic beverage formed with an upper portion with a sealable neck, and a lower portion with a bottom;

(b) A disc removably secured to said bottom with said disc comprising a battery unit, a control circuit, a light activated actuator and a plurality of electrical transistors, an audio record and a play chip, and a speaker.

2. The bottle for holding alcoholic beverages of claim 1, wherein said bottle is comprised of a material selected from the group: comprising transparent glass and light blocking glass and combinations thereof.

3. The bottle for holding alcoholic beverages of claim 1, further comprising a recess disposed in said bottom in the side opposite the cavity, and wherein said disc is removably secured to said bottom in said recess.

4. The bottle for holding alcoholic beverages of claim 1, further comprising an illumination element connected to said control circuit and said illumination element is turned on or off by means of said light activated actuator.

5. The bottle for holding alcoholic beverages of claim 1, wherein fluorescent paint is disposed on the surface of said bottom opposite said cavity.

6. The bottle for holding alcoholic beverages of claim 1, wherein said bottle is comprised of a material selected from the group comprising: transparent and light blocking polymers, plastics, acrylics, synthetic resins, metal, wood, porcelains, ceramics, laminates and combinations thereof.

7. The bottle of claim 1, further comprising an information display embedded in the bottom.

8. The bottle of claim 1, wherein the alcohol is vodka, rum, beer, gin, bourbon, scotch, cordials, tequila, mescal, and wine.

9. The bottle of claim 1, wherein the size of the bottle is selected from the group consisting of 750 ml, 1 liter, 175 liter, gallons, 375 ml, beer bottles, pony bottles, and mini-bottles.

10. The bottle of claim 1, wherein the audio chip plays drinking songs, spoken birthday greetings, wedding songs, animal sounds, recorded personal greetings and music.

11. The bottle of claim 1, wherein the bottle is colored glass selected from the group, blue glass, brown glass and green glass.

12. The bottle for holding alcoholic beverages of claim 1, further comprising a light blocking substance disposed on th surface of said bottom opposite said cavity and wherein said substance is selected from the group paper, plastic, glass or similar light blocking material.

* * * * *